United States Patent [19]

Neavel

[11] 4,039,425

[45] Aug. 2, 1977

[54] METHOD FOR PREPARING A COAL SLURRY SUBSTANTIALLY DEPLETED IN MINERAL-RICH PARTICLES

[75] Inventor: Richard C. Neavel, Baytown, Tex.

[73] Assignee: Exxon Research and Engineering Company, Linden, N.J.

[21] Appl. No.: 643,583

[22] Filed: Dec. 22, 1975

[51] Int. Cl.[2] ..... C10G 1/04; B03B 5/66

[52] U.S. Cl. ..... 208/8; 209/10; 209/158; 48/201

[58] Field of Search ..... 208/8, 10; 48/197 R, 48/201; 209/158, 454

[56] References Cited

U.S. PATENT DOCUMENTS

| | | | |
|---|---|---|---|
| 1,989,937 | 2/1935 | Lessing et al. | 209/158 |
| 2,055,161 | 9/1936 | Vissac | 209/158 |
| 2,441,820 | 5/1948 | Jenell | 208/157 |
| 2,859,872 | 11/1958 | Hirst | 209/158 |
| 3,261,559 | 7/1966 | Yavorsky et al. | 209/454 |
| 3,775,071 | 11/1973 | Hoffert et al. | 208/8 |
| 3,856,658 | 12/1974 | Wolk et al. | 208/8 |

*Primary Examiner*—Delbert E. Gantz

*Assistant Examiner*—James W. Hellwege

*Attorney, Agent, or Firm*—Yale S. Finkle

[57] ABSTRACT

A slurry of coal solids or similar carbonaceous material substantially depleted in mineral-rich particles is prepared for delivery to any desired place of use by introducing particulate coal and a suitable carrier liquid into a slurry preparation zone; passing a stream of slurry from the slurry preparation zone to a liquid-solids separator; returning a concentrated slurry stream from the separator to the slurry preparation zone; and passing a substantially clarified liquid stream from the separator to an elutriation zone, which communicates with and extends downward from the slurry preparation zone, in such a manner as to form an upward directed current in the elutriation zone. The velocity of the upward directed current is adjusted so that the heavy mineral-rich particles, which enter the slurry preparation zone with the particulate coal, pass downward through the upward directed current into a collection zone thereby resulting in the formation of a slurry in the slurry preparation zone which is substantially depleted in mineral-rich particles.

12 Claims, 1 Drawing Figure

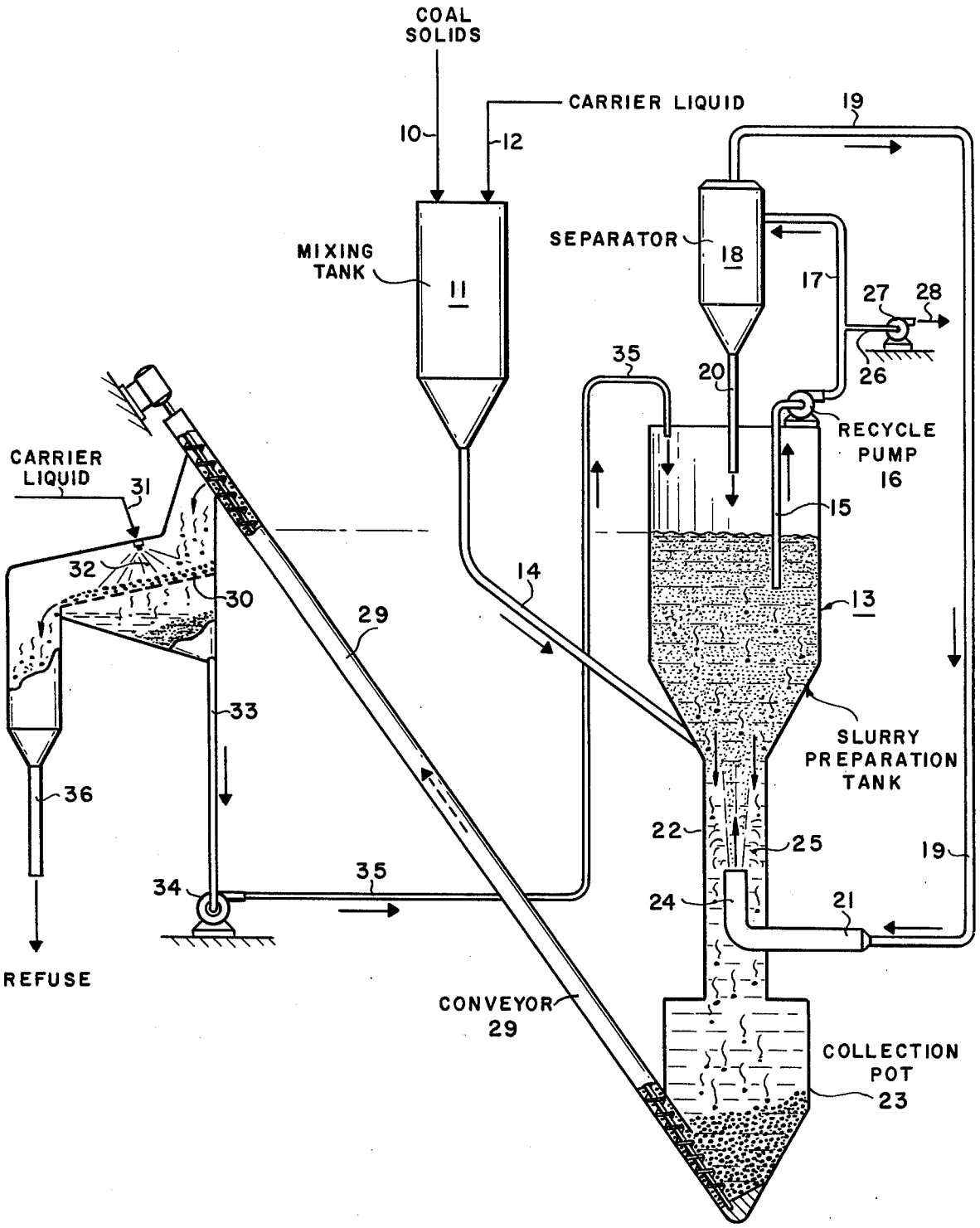
COAL SOLIDS
CARRIER LIQUID
10
12
19
MIXING TANK
11
SEPARATOR
18
17
27
28
26
35
20
RECYCLE PUMP 16
CARRIER LIQUID
31
15
32
30
14
13
29
33
SLURRY PREPARATION TANK
36
22
25
19
34
35
24
21
REFUSE
CONVEYOR 29
COLLECTION POT
23

METHOD FOR PREPARING A COAL SLURRY SUBSTANTIALLY DEPLETED IN MINERAL-RICH PARTICLES

BACKGROUND OF THE INVENTION

1. Field of the Invention

This invention relates to the preparation of slurries and is particularly concerned with preparing a coal slurry substantially depleted in mineral-rich particles.

2. Description of the Prior Art

Processes have been developed in the past and are currently being developed to convert coal or similar carbonaceous material into more valuable and directly usable products such as synthetic oil, synthetic gas and the like. In some of these processes, such as proposed coal liquefaction processes, it is desirable to transport the coal in slurry form through the processing equipment. Normally the slurry is formed by first crushing the coal and then dispersing the resultant particulate matter in a suitable carrier liquid, such as a coal-derived oil. Some type of recirculation system in which slurry is removed from and then returned to its preparation zone is normally utilized to prevent excessive particle settling in the carrier liquid.

The particles of coal dispersed in the carrier liquid normally vary in size from fine particles, less than 325 mesh on the U.S. Sieve Series Scale, to any desired top size. The particles also vary in density because of the uneven distribution of mineral matter throughout the raw coal. Some of the particles are mineral-rich and have a density substantially greater than those particles which are composed primarily of organic material. The mineral-rich particles are hard and tough and therefore may have a deleterious effect on the particular processing system through which the slurry is passed. They may, for example, plug small openings in pumps, pipes, reactors and other processing equipment; jam check valves in high pressure positive displacement pumps; accelerate erosion and wear of internal equipment surfaces; and, because of their inert nature, decrease reactor utilization.

To help alleviate the above-mentioned problems, it is desirable to remove the mineral-rich particles from the slurry before it is fed to its desired place of use. Removal methods based on size, such as screening, are not effective because the mineral-rich particles vary within the same size range as the organic-rich articles. Thus, it has been normal practice in the past to allow the mineral-rich particles to remain in the slurry as it is processed.

SUMMARY OF THE INVENTION

This invention provides a viable process for preparing a slurry composed of a carrier liquid and coal or similar carbonaceous solids substantially depleted in mineral-rich particles. In accordance with the invention, it has now been found that an elutriation step can be effectively integrated with conventional methods for preparing a slurry of coal or similar carbonaceous material to form a process which yields a slurry deficient in mineral-rich particles.

Carbonaceous solids and a carrier liquid are introduced into a slurry preparation zone. A stream of the slurry contained in the preparation zone is removed and passed to a liquid-solids separator where it is divided into a concentrated slurry stream and a substantially clarified liquid stream. The concentrated slurry stream is returned to the preparation zone to complete a recirculation system which serves to prevent excessive settling of particles in the carrier liquid. The substantially clarified liquid stream from the liquid-solids separator is simultaneously passed to an elutriation zone, which communicates with and extends downward from the slurry preparation zone, in such a manner as to form an upward directed current in the elutriation zone. The velocity of the upward directed current is adjusted so that the heavy mineral-rich particles, which enter the slurry preparation zone with the carbonaceous solids, pass downward through the upward directed current into a collection zone; while the less dense organic-rich particles remain suspended in the carrier liquid. The slurry thus formed in the slurry preparation zone is substantially depleted in mineral-rich particles and is ready for delivery to its desired place of use.

A zone of turbulence exists at the point where the current-inducing stream is upwardly injected into the elutriation zone. The turbulence will cause organic-rich particles present in the current-inducing stream to be diverted downward past the injection point into the collection zone. Passage of organic-rich particles of varying size into the collection zone in this manner is undesirable and is substantially avoided by use of a liquid-solids separator, normally a liquid cyclone, to produce a current-inducing stream of substantially clarified carrier liquid, which contains only a small number of fine organic-rich particles. These particles may be easily separated on the basis of their smaller size from the larger mineral-rich particles in the collection zone and returned to the slurry preparation zone where they are economically utilized by passing as part of the slurry to the desired place of use.

The process of this invention has numerous advantages over previous methods for preparing slurries of carbonaceous material. Integration of an elutriation step with a recirculation system facilitates the effective removal of a significant proportion of the mineral-rich particles from a slurry of coal or similar carbonaceous material, thereby alleviating plugging and erosion that may occur in downstream processing equipment.

BRIEF DESCRIPTION OF THE DRAWING

The single FIGURE in the drawing is a schematic flow sheet of a process for preparing a coal slurry deficient in mineral-rich particles for delivery to a high pressure reactive system carried out in accordance with the invention.

DESCRIPTION OF THE PREFERRED EMBODIMENT

The process depicted in the drawing is one for preparing a coal slurry substantially depleted in mineral-rich particles for delivery to a high pressure reactive system such as a coal liquefaction process, a coal gasification process or the like. It will be understood that the invention is not restricted to the particular process shown in the drawing and that it can be used in conjunction with other processes in which it is desired to prepare a slurry of carbonaceous solids substantially depleted in mineral-rich particles for delivery to any desired place of use. The invention, for example, may be used with a process in which it is desirable to supply a slurry of char, solid residues from a liquefaction process or the like to any type reactive system or slurry pipeline.

In the process shown in the drawing, coal solids are introduced into mixing tank or similar device 11 via line 10. The coal solids are produced in a preparation plant, not shown in the drawing, in which a bituminous coal, subbituminous coal, lignite or similar carbonaceous material is crushed in a conventional hammer of impact mill to a suitable size, preferably to about 8 mesh or smaller on the U.S. Sieve Series Scale.

In the mixing tank the coal solids are suspended in a suitable carrier liquid, which is injected into the tank via line 12, by means of a slurry mixer driven by an electric or hydraulic powered motor. The carrier liquid utilized will normally depend on what the ultimate use of the slurry will be. If the slurry is to be transported in a pipeline, the carrier liquid may be either water or oil. If, on the other hand, the slurry is to be transported into a high pressure reactive system, such as a coal liquefaction process to convert the dissolvable portions of the coal into liquid, the carrier liquid will normally be a coal-derived oil, preferably a hydrogen donor solvent which boils in the range from about 300° F. to 850° F. at atmospheric pressure. The coal solids and carrier liquid are normally mixed in a liquid-to-coal ratio of from about 0.8:1 to about 2:1.

The density of the coal particles injected into mixing tank 11 will vary because the raw coal contains mineral matter unevenly distributed throughout its organic structure. The mineral-rich particles, those particles which contain from about 50 weight percent to 100 weight percent mineral matter, resemble rock particles and are hard and tough. In general, the specific gravity of the mineral-rich particles will vary over the range from about 1.7 to about 5.2. The organic-rich particles, those particles composed primarily of organic material, are soft and friable and will normally have a specific gravity from about 1.25 to about 1.7. Before the raw slurry formed in mixing tank 11 is delivered to its desired place of use, it is desirable to remove the hard and tough mineral-rich particles from the carrier liquid in order to help prevent plugging of small openings in pumps, pipes, reactors and other processing equipment; to guard against the jamming of check valves in high pressure positive displacement pumps; to alleviate rapid erosion and wear of the processing equipment; and to maintain high reactor utilization by decreasing the amount of inert mineral material introduced into a reactive system. It has been found that the heavier mineral-rich particles can be removed from the raw slurry by integrating an elutriation step with conventional methods for preparing a slurry. Such a process is discussed in detail below.

The raw slurry formed in mixing tank 11 is passed through line 14 to the bottom of slurry preparation tank 13. Elutriation line 22 connects with and extends downward from the bottom of the slurry preparation tank. The heavier mineral-rich particles introduced into slurry preparation tank 13 with the raw slurry are removed by elutriation in line 22 and accumulated in collection pot or similar device 23. The lighter coal solids or organic-rich particles remain suspended in the carrier liquid to form a slurry in tank 13 that is substantially depleted in mineral-rich particles.

The raw slurry may be introduced into tank 13 at any level. It is preferable, however, to inject the raw slurry near the bottom of the tank so that the mineral-rich particles may gain easy entrance to elutriation line 22. In this regard, it may be advantageous to inject the raw slurry directly into elutriation line 22 near its junction with the bottom of slurry preparation tank 13.

Slurry preparation tank 13 may be any vessel of sufficient size which is operated at atmospheric pressure. It may, for example, be a steam jacketed tank which is capable of maintaining the temperature of the slurry sufficiently high, between about 212° F. and 350° F., to evaporate water from the coal and thereby serve as an effective slurry drier.

The slurry in preparation tank 13 is removed from a predetermined level by adjustable dip leg 15 and is passed by means of recycle pump 16 and line 17 to liquid cyclone or similar liquid-solids separator 18. Here the slurry is divided into a substantially clarified liquid overflow exiting the cyclone via liquid cyclone overflow line 19 and a concentrated slurry underflow exiting the cyclone through liquid cyclone underflow line 20. The separation in the cyclone occurs by centrifugal and centripetal force induced by the pressure drop developed across the device. Liquid cyclone 18 is selected and the pressure differential across it is adjusted by the slurry flow rate to the cyclone in line 17 so that substantially all of the particles in the slurry will exit the cyclone in the concentrated slurry underflow and only a small number of fine particles will be carried out of the cyclone in the clarified liquid overflow.

The concentrated slurry underflow is returned to slurry preparation tank 13 via liquid cyclone underflow line 20, thus completing a recirculation system consisting of adjustable dip leg 15, recycle pump 16, line 17, and liquid cyclone underflow line 20. Such a recirculation system is normally necessary to prevent excessive particle settling in the carrier liquid. The clarified liquid overflow is passed through liquid cyclone overflow line 19 into line 21 and is then injected through current-inducing inlet line 24 into elutriation line 22 to form an upward directed current. The large, heavy mineral-rich particles are removed from the slurry by means of the elutriation process taking place in line 22 while a size and density classification simultaneously occurs in tank 13 to form a stratification of coal solids in the slurry.

The settling velocity of the particles dispersed in the carrier liquid in slurry preparation tank 13 and elutriation line 22 is governed by Stoke's law which states that the maximum settling rate of a particle is defined by the following equation:

$$V_m = \frac{2}{9} \frac{(\rho_s - \rho) r^2 g}{\mu}$$

where $V_m$ = maximum or terminal settling velocity of a particle $\rho s$ = the specific gravity of a particle $\rho$ = the specific gravity of the carrier liquid $r$ = the radius of a particle $q$ = the acceleration of gravity $\mu$ = the viscosity of the carrier liquid.

It can be seen from the above equation that the settling rate of each individual particle is directly proportional to the size and density of the particle. Thus the heaviest, largest mineral-rich particles will settle at a faster rate than the smaller or less dense particles. By adjusting the velocity of the upward directed current of clarified liquid injected into elutriation line 22 through current-inducing inlet line 24, the larger and heavier particles can be separated from the other coal particles. Each particle whose settling velocity, $V_m$, is less than the velocity of the upward directed current in the elutriation line will remain suspended in the carrier liquid contained in the slurry preparation tank; while each particle whose settling velocity is greater due to its high density, large size or both will flow downward by gravitational force through elutriation line 22 past current-inducing inlet line 24 into collection pot or similar device 23.

The velocity of the upward directed current may be set so that only the more troublesome mineral-rich particles, those having a specific gravity from about 2.5 to about 5.2, are removed. Such a velocity insures that only a small amount of the valuable organic matter is removed from the slurry as part of the mineral-rich particles. As the velocity of the upward directed current is decreased, a greater proportion of the mineral-rich particles along with larger organic-rich particles will pass downwardly through the current into the collection pot thus resulting in the removal of a larger amount of the organic matter from the slurry. The optimum velocity will normally depend on the amount of organic matter that it is economically feasible to remove from the slurry along with the mineral-rich particles.

The upward directed current in elutriation line 22 will result in the formation of a net upward liquid velocity in slurry preparation tank 13. This upward flow causes a stratification of organic-rich particles according to density and size in tank 13; the larger, heavier particles being found closer to the bottom. Further, a much greater concentration of particles will exist near the bottom. To maintain an equilibrium between particle sizes in the tank, a portion of the lower more concentrated phase may be withdrawn, ground to a finer size in an appropriate device such as a ball mill, and returned to the slurry preparation tank. By use of an adjustable dip leg to remove the finished slurry from the tank, advantage may be taken of the above-described stratification phenomenon to vary the particle size and particle concentration in the finished slurry delivered to the desired place of use.

The finished slurry formed in slurry preparation tank 13 will contain particles of fairly uniform size and density at any particular level and will be deficient in mineral-rich particles. Care is necessary in transporting the finished slurry to its desired point of use to maintain the coal particles suspended in the carrier liquid. This may be accomplished by use of a short slip stream. The finished slurry is withdrawn through adjustable dip leg 15 from any desired level in preparation tank 13. It is then passed by means of recycle pump 16 through line 17 to liquid cyclone 18. A portion or slip stream of the slurry flowing in line 17 is removed via line 26 and passed to positive displacement pump 27 where the slurry is pressurized and charged through line 28 to a high pressure reactive system.

The slip stream withdrawn through line 26 is large enough to supply the required amount of slurry to the high pressure reactive system. Line 17 is sufficiently larger than the slip stream so that the amount of slurry flowing through line 17 is not substantially reduced by the amount of slurry withdrawn from the line. Line 26 is short enough so that the constant flow of slurry in line 17 pass the entrance to line 26 will keep the particles in the slip stream suspended so that they will not settle out while the slurry passes through the inlet check valve of pump 27.

A zone of turbulence will exist at the point where the current-inducing stream is upwardly injected into the elutriation zone. This zone of turbulence, represented by reference number 25 in the drawing, consists of eddies formed as the upward directed current of clarified liquid passes from the outlet of current-inducing inlet line 24 into elutriation line 22. These eddies will cause some of the particles suspended in the current-inducing stream to be diverted downward past the injection point into collection pot 23 along with the mineral-rich particles. To prevent a large amount of organic matter in the form of particles of varying size from being diverted into the collection pot, it is necessary that the current-inducing stream be a substantially clarified stream of carrier liquid. Such a stream is formed by use of liquid cyclone 18 to produce a clarified liquid overflow containing only a small number of fine particles. It is generally preferable that these fines be of a size less than about 200 mesh on the U.S. Sieve Series Scale.

The particulate matter that collects in pot 23 consists of large, heavy mineral-rich particles such as pyrite and other rock-like substances, and fine coal particles which have been diverted from the current-inducing stream into the collection pot by the turbulence in zone 25. It is economically desirable to remove these fine organic-rich particles from the larger mineral-rich particles and return them to slurry preparation tank 13.

The particles in collection pot 23 are mechanically transferred via screw conveyor or similar positive displacement apparatus 29 onto screen 30. As the particles move downwardly across the sloping screen, they are sprayed with carrier liquid injected into spraying zone 32 via line 31. The holes in the screen are of such a size as to allow only the fine particles of coal to be washed through the screen into line 33. The slurry of fine coal particles and carrier liquid formed in the entrance zone to line 33 is recycled to slurry preparation tank 13 via pump 34 and line 35. The refuse, mineral-rich particles that do not pass through the screen, is washed off the screen into line 36. The refuse exiting line 36 may be passed downstream for further processing to recover carrier liquid which then may be recycled to the feed system.

It will be apparent from the preceding discussion that the invention provides a viable and effective process for preparing and supplying a slurry deficient in mineral-rich particles to any desired place of use.

I claim:

1. A process for preparing a slurry composed of a carrier liquid and coal or similar carbonaceous solids substantially depleted in mineral-rich particles for delivery to any desired place of use which comprises:

a. introducing said carbonaceous solids and said carrier liquid into a slurry preparation zone, said slurry preparation zone communicating with an elutriation zone extending downward from the bottom of said slurry preparation zone;

b. passing a stream of slurry from said slurry preparation zone to a liquid-solids separator;

c. returning a concentrated slurry stream from said separator to said slurry preparation zone;

d. passing a substantially clarified liquid stream from said separator to said elutriation zone in such a manner as to form an upward directed current of predetermined velocity in said elutriation zone, whereby mineral-rich and other particles in said slurry preparation zone and said elutriation zone having a settling velocity greater than said predetermined velocity pass downward through said elutriation zone; and e. passing a slurry stream deficient in mineral-rich particles from said slurry preparation zone to said place of use.

2. A process as defined by claim 1 wherein said carbonaceous solids comprise coal.

3. A process as defined by claim 1 wherein said carbonaceous solids comprise char.

4. A process as defined by claim 1 wherein said carrier liquid comprises a hydrocarbon oil.

5. A process as defined by claim 1 wherein said liquid-solids separator comprises a liquid cyclone.

6. A process as defined by claim 1 wherein said place of use comprises a high pressure reactive system.

7. A process for preparing a slurry composed of a hydrocarbon oil and coal solids substantially depleted in mineral-rich particles for delivery to a high pressure reaction zone which comprises:

a. mixing raw coal solids with a hydrocarbon oil in a mixing zone to form a raw slurry;

b. passing said raw coal slurry to a slurry preparation zone, said slurry preparation zone communicating with an elutriation zone extending downward from the bottom of said slurry preparation zone;

c. passing a stream of slurry from said slurry preparation zone to a liquid cyclone;

d. returning the concentrated slurry underflow from said liquid cyclone to said slurry preparation zone;

e. passing the substantially clarified liquid overflow from said liquid cyclone to said elutriation zone in such a manner as to form an upward directed current of predetermined velocity in said elutriation zone, whereby mineral-rich and other particles in said slurry preparation zone and said elutriation zone having a settling velocity greater than said predetermined velocity pass downward through said elutriation zone; and f. passing a slurry stream deficient in mineral-rich particles from said slurry preparation zone into said high pressure reaction zone.

8. A process as defined by claim 7 wherein said hydrocarbon oil comprises a coal-derived oil.

9. A process as defined by claim 7 wherein said slurry preparation zone is maintained at a temperature from about 212° F. to about 350° F.

10. A process as defined by claim 7 wherein said particles passing downward through said elutriation zone pass into a collection zone, said collection zone communicating with the bottom of said elutriation zone.

11. A process as defined by claim 10 wherein fine coal particles are separated from said particles in said collection zone and returned to said slurry preparation zone.

12. A process as defined by claim 7 wherein said high pressure reaction zone comprises a coal liquefaction reactor wherein said coal solids are liquefied.

* * * * *